US007197398B2

(12) United States Patent
Azari

(10) Patent No.: US 7,197,398 B2
(45) Date of Patent: Mar. 27, 2007

(54) METHOD FOR DESIGNING FORMATION TESTER FOR WELL

(75) Inventor: Mehdi Azari, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 90 days.

(21) Appl. No.: 11/084,567

(22) Filed: Mar. 18, 2005

(65) Prior Publication Data

US 2006/0212223 A1 Sep. 21, 2006

(51) Int. Cl.
*G01V 9/00* (2006.01)

(52) U.S. Cl. ..... 702/13; 702/9; 703/10

(58) Field of Classification Search ..... 702/6, 702/9, 11, 12, 13; 703/10
See application file for complete search history.

(56) References Cited

U.S. PATENT DOCUMENTS 3,412,607 A 11/1968 Jensen
3,427,653 A 2/1969 Jensen
5,092,167 A 3/1992 Finley et al.
6,352,110 B1 3/2002 Langseth et al.

OTHER PUBLICATIONS

Simmons, Jeffrey F., "Closed Chamber Well Test Analysis By Superposition Of The Constant Pressure Cumulative Influx Solution To The Radial Diffusivity Equation", Standford Geothermal Program Interdisciplinary Research in Engineering and Earth Sciences, SGP-TR-87, Feb. 1985, 115 pages.*

Dabral, Ashish, "Green Well Testing", A Report Submitted To The Department Of Petroleum Engineering Of Stanford University, Jun. 2003, 44 pages.*

European Search Report, EP 06 25 1359, PAC/24968 EP, Aug. 9, 2006, 5 pgs.

Alexander, L.G., "Theory and Practice of the Closed-Chamber Drillstem Test Method," XP-002387906, Journal of Petroleum Technology, Dec. 1977, pp. 1539-1544.

* cited by examiner

*Primary Examiner*—Donald McElheny, Jr.
(74) *Attorney, Agent, or Firm*—Al C. Metrailer

(57) ABSTRACT

A method for designing a closed-chamber drillstem test system. Parameters of available equipment and a well to be tested are collected. Initial or proposed chamber size and chamber pressurizing fluids are then selected. A simulation of a test is then performed. The simulation is performed in time increments, with pressure in the well assumed to be static during each time increment. Calculated flow volume from the formation during each increment is used to adjust pressure in the well for the next increment. The process is continued until the test would be considered complete based on an optimization parameter. If the total simulated time to complete the test is not in a desirable range, the initial chamber parameters are changed and the simulation is run again. The process is repeated until the simulated test time reaches a desirable range.

16 Claims, 3 Drawing Sheets

METHOD FOR DESIGNING FORMATION TESTER FOR WELL

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to testing hydrocarbon producing formations and more particularly to a method for designing a formation test system for use in a well.

BACKGROUND OF THE INVENTION

During drilling of oil and gas wells, it is desirable to test earth formations to determine their productive characteristics, e.g. how much oil and/or gas may be in the formation and how fast it can be produced. It is desirable to learn this information as soon as possible, e.g. before decisions are made to spend the money needed to complete a well for permanent production. One type of testing before completion is referred to as drillstem testing, since the primary work string available during drilling is the drillstring itself, although the equivalent testing may be done with other work strings or with a wireline supported tool.

One conventional drillstem test allows fluids produced from the formation to flow up the drillstring for a period of time. The drillstring is typically provided with a packer that is set in the annulus between the drillstem and the borehole above the formation of interest. A valve in the drillstring may then be closed shutting in the well so that the pressure below the packer may stabilize at natural formation pressure. The test equipment normally includes pressure and temperature sensors to measure and record and/or transmit to the surface bottomhole pressure data and temperature data. After the downhole conditions have stabilized, the valve in the drillstring is opened allowing formation fluids to flow up the drillstring while downhole pressure and temperature are measured. After a quantity of fluids is produced, the valve is usually closed again and pressure and temperature are measured as the downhole pressure returns to its natural formation pressure. Various characteristics of the formation may be derived from the produced fluids and from the pressure and temperature data collected.

The conventional open flow drillstem tests often result in production of large quantities of hydrocarbons when facilities have not yet been installed for handling such quantities. To avoid this and other problems, the closed-chamber drillstem test was developed. In closed-chamber testing, a portion of a drillstring or other tubing is provided with a pair of valves allowing flow through the tubing to be controlled at two spaced apart locations in the tubing. The space in the tubing between the valves forms a test chamber. A packer is typically used to seal the annulus above the formation to be tested and the lower valve is closed to allow pressure in the borehole below the packer to stabilize at natural formation pressure. Pressure and temperature sensors monitor conditions in the borehole. While the lower valve is closed, the test chamber is initially filled, at least partly, with a gas and the upper valve is closed. Some liquid may also be placed in the chamber, but the pressure in the chamber at the lower valve is set below the natural formation pressure. After borehole conditions stabilize, the lower valve is opened allowing formation pressure to flow formation fluids into the test chamber compressing the gas in the test chamber. Flow reduces as chamber pressure increases and stops when the pressure at the bottom of the test chamber reaches the natural formation pressure. Pressure and temperature data is recorded as the test is performed. In a properly designed closed-chamber drillstem test, the data covers a continuous range of flow rates extending from an initial high value to essentially no flow at the end of the test. Data from such a properly designed test may be analyzed by known methods to determine the formation characteristics. The closed-chamber test results in less produced fluids that need to be disposed of, may take less time than open flow testing, and has other advantages. However, if the closed-chamber system is not properly designed, the chamber may fill too quickly, resulting in insufficient data for good analysis, or too slowly, resulting in either an incomplete test if it is terminated too soon or an undesirably long test period.

SUMMARY OF THE INVENTION

The present disclosure provides a method for designing a closed-chamber test system that allows collection of desirable data while limiting the testing time to a desirable length. Information on the physical sizes of available tubing, the well, and the formation to be tested and information on formation fluids, i.e. oil, gas, water, etc., and natural pressure and temperature are collected. A proposed chamber size and chamber pressurizing fluids are then selected. A simulation of a closed-chamber drillstem test is then performed using the known parameters and the proposed test chamber parameters. The simulation is performed in time increments, by assuming constant pressure to exist in the well adjacent the formation during each time increment. Calculated flow volume from the formation during the first time increment is used to adjust pressure in the well adjacent the formation based on assumed flow into the chamber. Flow volume during a second time increment is then calculated based on the new assumed constant pressure differential. The process is continued until the test would be considered complete, e.g. based on pressure differential dropping to a low value. If the simulated total time to complete the test is considered too short or too long, the proposed chamber parameters are adjusted and another simulation is run. The process is repeated until the simulated test time reaches a desirable range. The final proposed design may then be used to build a real closed-chamber test system and perform an optimized closed-chamber drillstem test.

In one embodiment, the test chamber is at least partly filled with a gas cushion that remains in the chamber during the test. Pressure in the gas cushion is adjusted at each time increment based on compression that would result from the calculated flow of formation fluids into the chamber. In an alternate embodiment, the initial gas cushion pressure may be maintained at a substantially constant value during the test.

In another embodiment, the test chamber may be an open chamber test. The simulation of the present invention may be used to determine performance of an open chamber test system by assuming that gas cushion pressure is essentially atmospheric pressure and does not change during the test.

DETAILED DESCRIPTION OF THE PREFERRED EMBODIMENTS

In the description of the embodiments, various elements may be described as being above or below, or up-hole or down-hole from, other elements. Such references are made with reference to the normal positioning of elements in a vertical borehole. However, the embodiments may also be used in deviated or horizontal boreholes, in which case above or up-hole means closer to the surface location of a well and below or down-hole means closer to the end of the well opposite the surface location, even though the two elements may be at the same vertical elevation.

Figure 1:
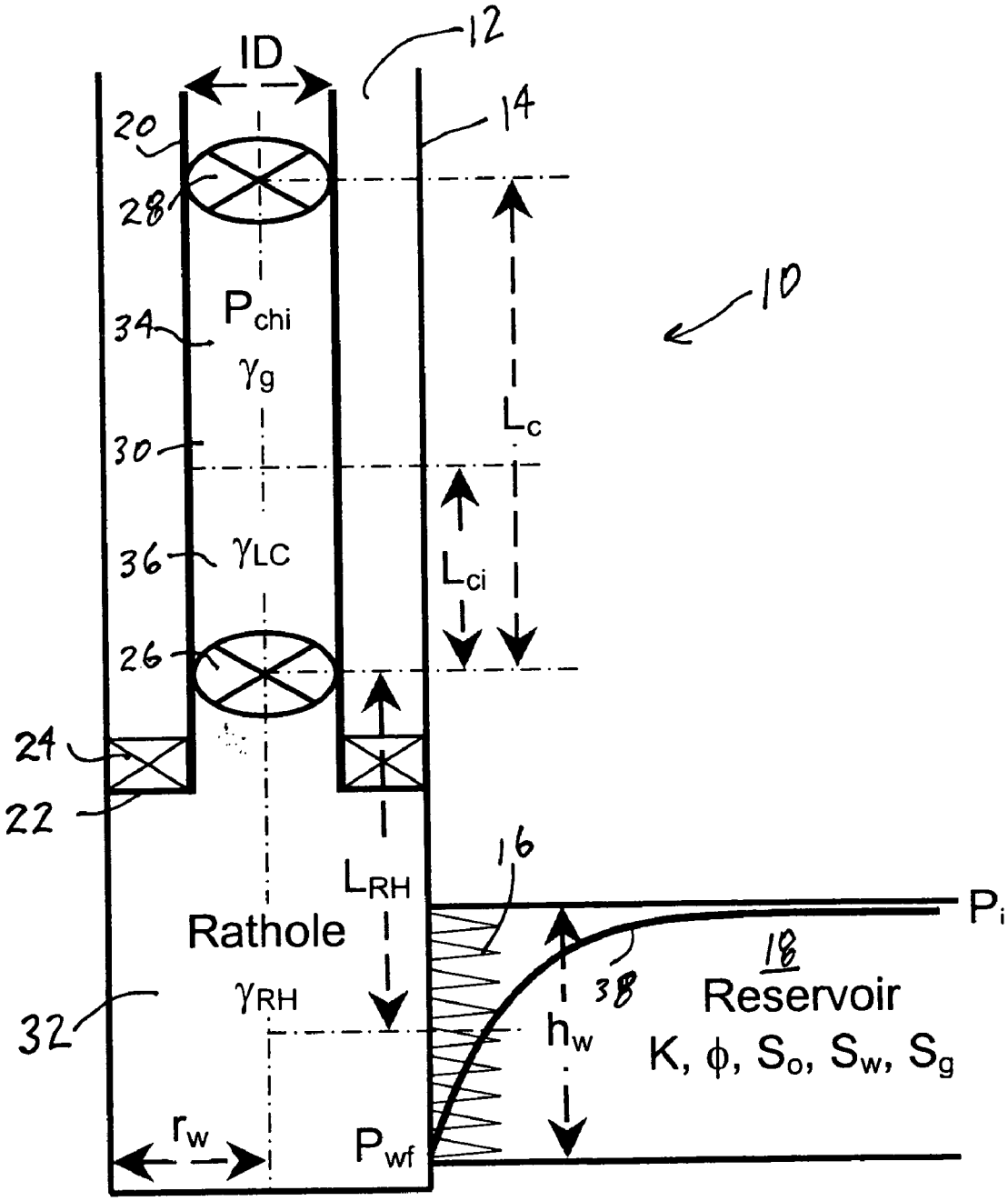
FIG. 1 is a diagram of a closed-chamber drillstem test system identifying various parameters used in an embodiment of the present invention.

FIG. 1 provides an illustration, not to scale, of a model of a closed-chamber drillstem test system 10 and various parameters used in an embodiment of the present invention. The system 10 is shown positioned in a well 12, which in this embodiment includes a casing 14. Perforations 16 have been formed through casing 14 and into an earth formation 18 to permit production of fluids from the formation 18. The well 12 has been drilled through the formation 18 and usually to a distance below the formation 18. The lower end 32 of the well 12, especially that part below casing 14 is usually referred to as the rathole. In this embodiment, the rathole portion 32 also includes that part of the well below the test system 10. The present invention may also be used in open hole wells, that is, wells that do not include a casing 14. In open hole wells, the perforations 16 are normally not needed.

The test system 10 is formed in part of a length of tubing 20 which may be drill pipe, coiled tubing, or other oilfield tubular goods. In this embodiment, the tubing 20 extends from the surface location of the well, not shown, to a depth location 22 above the formation 18. The length of the tubing 20 is therefore about equal to the length of the well 12 as measured from the surface location to the formation 18, and may be many thousands of feet. At the depth location 22, a packer 24 has been deployed to seal the annulus between the tubing 20 and the casing 14. A lower valve 26 and an upper valve 28 are carried in the tubing 20 and each can be opened or closed to allow or block flow of fluids through the tubing 20. The space between valves 26 and 28 within the tubing 20 defines a closed well testing chamber 30, which may be hundreds or thousands of feet long. When lower valve 26 is closed and the packer 24 has been deployed, the lower part 32 of the well 12 is exposed to the natural or initial pressure present in the formation 18, but flow of fluids up-hole is blocked by the packer 24 and valve 26.

In normal operation of the system 10, the test chamber 30 is filled with pressurizing fluids including a gas cushion 34 in the upper portion and, if desired, a liquid cushion 36 in the lower portion. These fluids may be selected to establish a desired starting test pressure in the chamber 30 in the wellbore 32 adjacent the center of the perforations 16. When valve 26 is open, the wellbore pressure adjacent perforations 16 is the sum of the pressure at valve 26 plus the pressure head generated by borehole fluids between the perforations 16 and the valve 26. When an actual test is performed, the valve 26 is opened lowering pressure in the wellbore adjacent the perforations 16 to the starting test pressure and allowing fluids to flow from reservoir 18 into the chamber 30 due to the pressure difference between initial pressure in the formation 18 and the pressure in the portion 32 of well 12 adjacent the perforations 16. As fluid flows into the chamber 30, gas portion 34 is compressed and the column of liquid 36 in the chamber 30 increases until pressure in the well adjacent the formation 18 equals the natural pressure of formation 18 and flow from the formation stops. A typical pressure curve inside the formation 18 as a function of radial distance into the formation is illustrated at 38, showing that the pressure at perforations 16 drops when valve 26 is opened and showing the pressure gradient between the perforations 16 and the natural or initial formation pressure that drives formation fluids into the borehole 32. As noted above, pressure and temperature in the well is recorded as the test is performed and the recorded data may then be used to calculate important characteristics of the formation 18. At the end of the test, the produced fluids in the chamber 30 may be lifted to the surface for further testing.

The size, i.e. volume, of the test chamber 30, and in particular the volume and pressure of the gas portion 34, determines to a great extent whether a closed-chamber drillstem test will be considered to be successful. There are several desirable characteristics of a successful test. The test should last long enough that good pressure and temperature data may be collected. If a chamber 30 is too small, it will fill quickly and the analysis methods for the collected data will not work well. If the chamber is too small, the depth of investigation in the formation may be less than desired. If the chamber is too large, it may take a long time for the pressure in the test chamber to approximate the initial formation pressure resulting in increased operating costs without substantially improving the quality of data collected. An over sized chamber 30 will also collect more fluids and increase disposal costs. In the present embodiment, a test chamber is designed with the goal of completing an actual test in a preselected time range. In one embodiment, the preselected time range is from about one hour to about two hours. This range is considered a good balance between collecting good data and minimizing operating costs.

FIG. 1 illustrates a number of parameters that are used in an embodiment of the invention. As indicated above, the volume of chamber 30 and, in particular, the volume of the gas portion 34 are important in achieving a desirable test result. These volumes may be specified in terms of the tubing 20 inner diameter, ID, 40, the total chamber length, $L_c$, and the initial liquid cushion length, $L_{ci}$, from which dimensions the volumes of the gas cushion 34, the liquid cushion 36 and the total test chamber 30 may be calculated. In determining the formation to borehole pressure differential, it is also important to know the distance from the middle of the perforations 16 to the bottom of chamber 30, i.e. to the valve 26, $L_{rh}$, since borehole fluids in the rathole portion 32 provide a hydrostatic head proportional to the fluid density and the length $L_{rh}$. The initial gas pressure in the chamber portion 34 is labeled $P_{chi}$ and the temperature of this gas at the top of the chamber 30 is $T_{chi}$. The density of the gas in the upper chamber portion 34, or gas cushion gravity relative to air, is referred to a $G_{gc}$. In the preferred embodiment, the gas is nitrogen with a gravity of 0.967. The density or gravity of the liquid cushion is referred to as $G_{lc}$. The density or gravity of the fluid in the rathole portion 32 of the well, i.e. below the valve 24, is referred to as $G_{irh}$. The wellbore radius is indicated as $r_W$, and may generally be assumed to be the radius of the drill bit used to drill the well 12. Each of these values is either known at the time it is desired to design a closed-chamber test system or a value that may be specified as part of the design of a closed-chamber test system.

Other parameters used in the embodiments concern the formation 18 itself and may be measured from well logs, core samples, or other means known in the art or may be inferred from data from other wells, e.g. nearby wells in the same geological formation. While these parameters are not controllable, they are usually known within a certain degree of error. The initial formation pressure, $P_i$, is the natural pressure in formation 18 when no fluids are being produced from, or injected into, the formation. A skin damage value, s, may be estimated based on the drilling fluids used, the drilling overbalance pressure, etc. Since skin damage is generally estimated over a range, simulations are desirably run at both extremes of the range. The formation thickness, $h_W$, is the measured or estimated thickness from the top to the bottom of formation 18 and not the distance between top and bottom perforations 16, if perforations are used. The formation porosity is referred to as phi. The formation permeability, $K_r$, is important in simulating the flow of fluids from formation 18. To the extent that a range of permeability is estimated, simulations are desirably run at the extremes of the range.

Certain characteristics of fluids in the formation 18 are also usually known based on collected samples or correlations to nearby wells and are important in designing a closed-chamber drillstem test. The formation gas gravity is referred to as $G_g$ and is usually specified relative to air, with air being one. The oil API gravity at standard conditions is usually known. Initial ratio of gas dissolved in the oil at initial reservoir conditions is referred to as $R_{si}$. Reservoir or bottomhole temperature is referred to as BHT. The bubble point pressure, $P_{bp}$, is the pressure below which gas dissolved in the formation oil will come out of solution in the oil.

Figure 2:
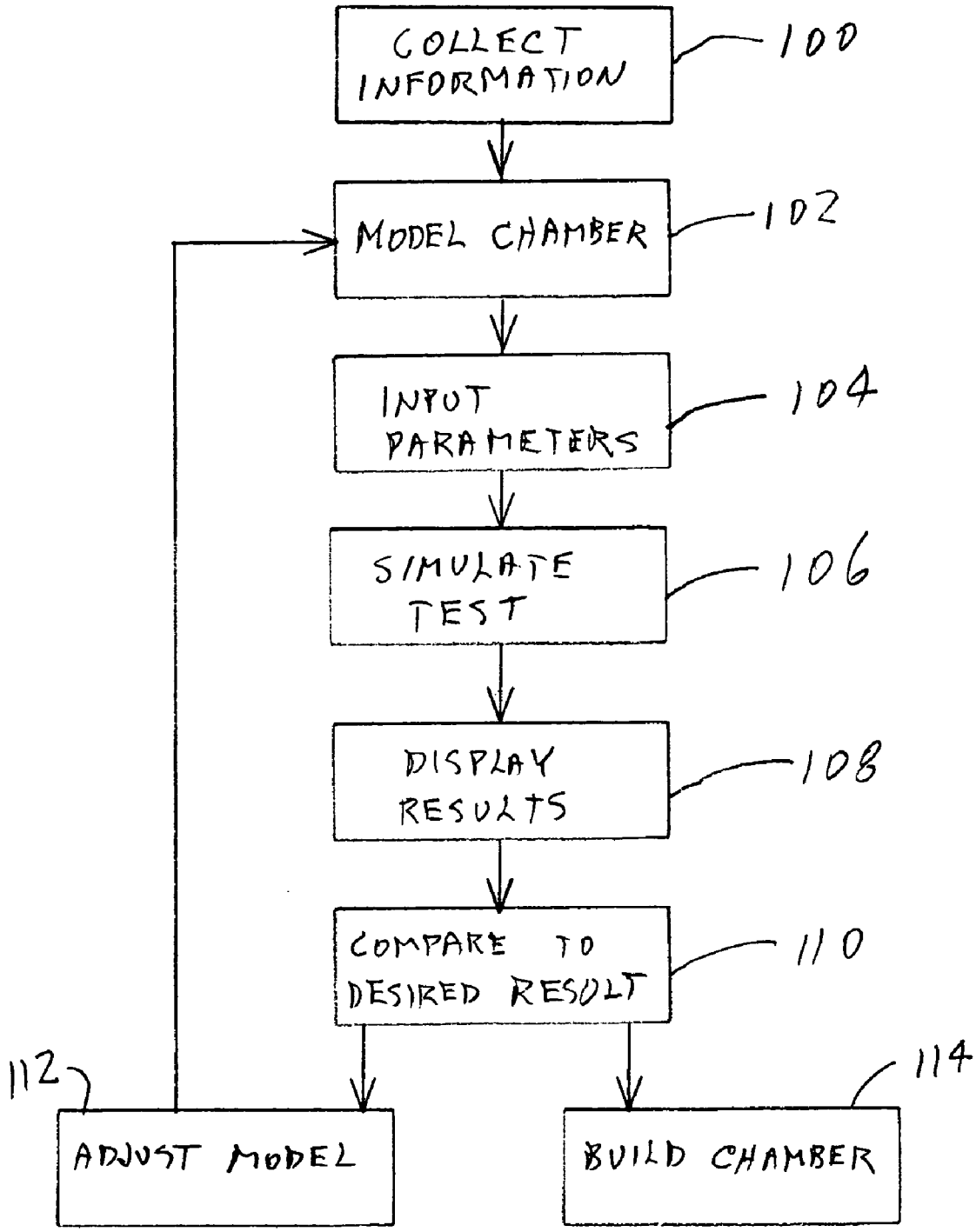
FIG. 2 is a flow chart illustrating a method of designing a closed-chamber drillstem test system according to an embodiment of the present invention.

FIG. 2 is a flow chart illustrating a closed-chamber test design method according to one embodiment. At step 100, the various data listed above is collected. As noted above, some of the parameters may be specified or assumed for purposes of this embodiment.

At step 102, a model or proposed chamber design is selected based on the known parameters, certain assumptions, and based on certain limitations that may be specified by the owner of the well to be tested. The diameter, ID, of the tubing 20 is normally fixed based on the diameter of casing 14. The volume of chamber 30 is therefore determined primarily from the length, $L_c$, of the chamber 30. The maximum volume is limited to the length of the tubing 20. An initial proposed length of chamber 30 may be made based in part on the maximum sample volume that may be desirable and the radius of investigation into the formation that is desired. The length of chamber 30 is also affected by the pressurizing fluids 34, 36 in chamber 30.

The pressurizing fluids 34, 36 are selected to provide a starting test pressure in the borehole adjacent perforations 16 based on several factors. The starting pressure at the perforations 16 will be the sum of the pressure at the bottom of gas cushion 34, the hydrostatic head produced by the liquid cushion 36, if used, and the hydrostatic head of borehole fluid between the valve 26 and the perforations 16.

Normally, the starting pressure at perforations 16 should be above the bubble point of the oil in formation 18. If gas comes out of solution during the test, the analysis of the pressure data collected may be adversely affected. If the formation 18 is poorly consolidated, it may be preferred to limit the maximum pressure drop between the formation 18 initial pressure and the borehole starting pressure to prevent erosion and other damage to the well 12. The starting pressure should normally be at or above the higher of the pressures required to be above bubble point and to avoid formation damage. However, it is desirable that the starting pressure not be substantially above the higher of these lower limits.

When the starting pressure at the perforations 16 is selected, the starting pressure at the bottom of chamber 30, i.e. at valve 26, may be estimated. The hydrostatic head of the borehole fluid in rathole 32 between the perforations 16 and the assumed position of lower valve 26 may be calculated and subtracted from the desired starting pressure at the perforations 16 to determine the starting pressure desired at the valve 26.

The liquid cushion 36 is not essential in closed-chamber drillstem test systems. In some cases, e.g. in high pressure formations, liquid cushion 36 may be desirable for increasing the starting pressure at valve 26 without increasing the pressure of gas cushion 34. The lower gas cushion pressure may provide a safer operation. If a liquid cushion is desired, its length may be selected based on the amount of pressure the liquid cushion is to provide at the bottom of chamber 30. From this pressure and the gravity, $G_{lc}$, of the liquid cushion, the vertical length of the liquid cushion portion $L_{ci}$ may be calculated.

The length of the gas cushion 30 may initially be estimated based on the required starting pressure at the valve 26 less the hydrostatic head of the liquid cushion 36 and the desired volume of a bulk sample of formation fluids that it is desired to produce. In this embodiment, the volume of produced fluids is limited to the volume change of the gas cushion 34 that occurs during the test when the formation fluid flows into chamber 30 and compresses the gas cushion 34. For example, if it is desired to produce twenty barrels of formation fluids and the starting pressure of the gas cushion is half the natural formation pressure, the initial volume of the gas cushion 34 may be roughly about forty barrels. From this volume, the length of the gas cushion 34 may be calculated and added to the length of the liquid cushion to provide an initial estimated total test chamber length, $L_c$.

As noted above, it is preferred to design a closed-chamber drillstem test system to perform an actual test in a well in a time of from about one hour to about two hours. The above described process for making an initial estimate of the test system 10 provides only a rough estimate of the volume of the test chamber 30, the volumes of the cushion fluids 34, 36, and the initial pressure in the gas cushion 34. If only these initial estimates are used to build an actual system and perform a test, there is a significant chance that the chamber will fill too quickly to obtain good data or will be terminated before the chamber has filled sufficiently to obtain good data. A prior art solution has been to provide an oversized chamber and operate the test system for a long time, e.g. eight hours, to be sure the chamber is filled. In this embodiment, the initial estimate for the system is used as only a model in a simulation of a test to determine whether the model can be used to build an actual test system that is likely to result in an optimized real test. It is apparent that other methods of providing an initial estimate may be used if desired. Regardless of what method is used to create an initial estimate or model, the present invention provides a method for evaluating the model based on all the physical parameters of the reservoir, wellbore, and the chamber and iteratively adjusting the model until an optimized system design is found.

In FIG. 2, at step 104, the above described initial estimate or model of the test system 10 and the other above described parameters are input into a simulation system in order to evaluate the performance of the initial estimate. At step 106, a closed-chamber drillstem test simulation is performed. A preferred simulation method is shown in FIG. 3.

Figure 3:
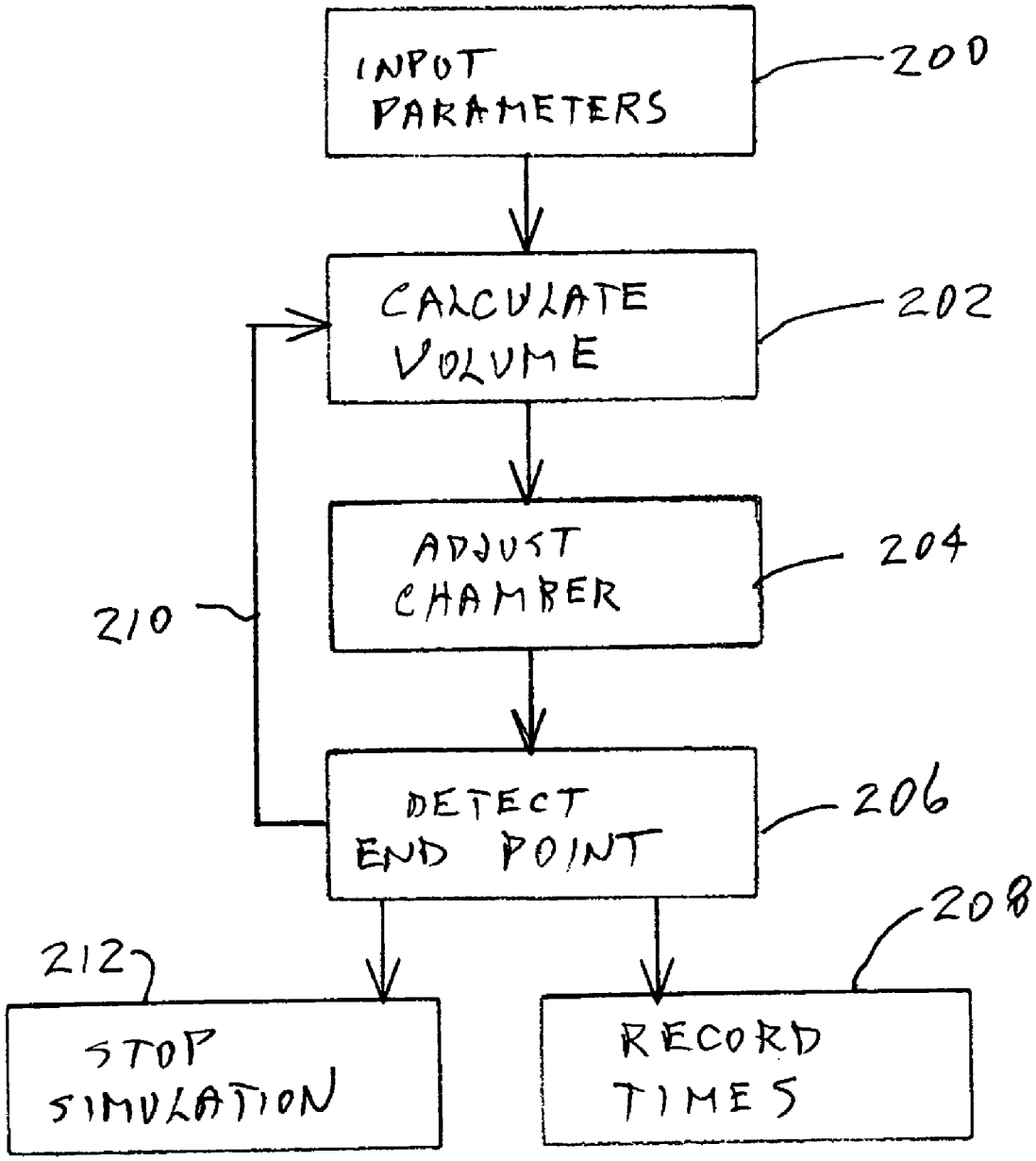
FIG. 3 is a flow chart illustrating a method of simulating a closed-chamber drillstem test according to an embodiment of the present invention.

FIG. 3 provides a flow chart of a method for simulating a closed-chamber drillstem test according to an embodiment of the present invention. At step 200, the parameters discussed above with reference to FIG. 2, step 104, including the initial estimate or model of the test system 10 are provided as inputs to a simulator. At step 202 it is assumed that valve 26 has been opened and the pressure in the rathole 32 adjacent perforations 16 has been reduced to the starting value estimated above. In this embodiment, the pressure in the borehole adjacent perforations 16 is assumed to remain constant during a first time increment and the flow of fluids from the formation into the borehole is calculated based on the pressure differential between the initial formation pressure, Pi, and the borehole pressure, the permeability of the formation 18, the skin damage, produced fluid gravity, and other parameters discussed above. In one embodiment, the first time increment is one quarter second. At step 204, the parameters of the chamber 30, in particular the pressure and volume of gas cushion 34 are adjusted, i.e. recalculated. The volume of fluid calculated from step 202 is added to the liquid cushion 36, the volume of the gas cushion is reduced by the produced fluid volume, a new gas cushion pressure is calculated, and a new borehole pressure at the perforations 16 is calculated. At step 206, the new values are compared to one or more optimization parameters and if an optimization parameter has been reached, the total of the time increments that have been simulated is recorded at step 208. As indicated by arrow 210, the process returns to step 202 and another flow volume is again calculated for the next time increment based on the new borehole pressure at the middle of perforations 16, again assumed to be constant during the time increment, and formation 18 parameters. This process is preferably repeated until a preselected simulation time has been reached and the simulation is then stopped at step 212. In an alternate method, the simulation may be stopped when one or more or all of the optimization parameters in step 206 have been reached.

As noted above, the initial time increment in this embodiment is about one quarter second. In this embodiment, steps 202, 204 and 206 are repeated in one quarter second increments for a first simulated time period of about fifty seconds, then the increments are increased to about one half second for a second simulated time period of about fifty seconds, and then the increments are increased to one second for a third time period that may be the remainder of the simulated time, i.e. for simulated time greater than 100 seconds.

In a preferred embodiment, the results calculated for each time increment are quality checked against certain limitations before the process continues to the next time increment. For example, if the initial system model has a very small chamber 30, it is possible that the calculated flow volume in the first increment, or a later increment, will exceed the available volume in the gas cushion 34 by compression and/or the resulting calculated pressure in the wellbore 32 adjacent the perforations 16 would be increased above the initial formation pressure. Neither of these results is physically possible. If the calculated results are not possible, the simulation is stopped, the results are discarded, and the simulation is restarted with a smaller first increment, e.g. one half the increment previously used. As noted above, the simulation may normally be started with increments of one quarter second. If the quality check detects an impossible result, the simulation may be restarted with an initial time increment of one eighth second. If the second try also results in an impossible result, the initial time increment may again be cut in half to one sixteenth second and the process started again. If the simulation does not provide a realistic result starting with an initial one-sixteenth second increment, it is preferred to stop the simulation and reevaluate the initial model for some basic physical misapplication before retrying.

If the simulation is restarted with a reduced first time increment of one eighth second, then the simulation may be continued with increments of one eighth second for the remainder of the first simulated time period of fifty seconds, then with increments of one quarter second for the second simulated time period of fifty seconds, increments of one half second for a third simulated time period from one hundred seconds to five hundred seconds and increments of one second for a fourth simulated time period extending beyond five hundred seconds.

If the simulation is restarted with a reduced first time increment of one sixteenth second, then the simulation may be continued with increments of one sixteenth second for the remainder of the first simulated time period of fifty seconds, then increments of one eighth second for the second simulated time period of fifty seconds, increments of one quarter second for the third simulated time from one hundred seconds to five hundred seconds, increments of one half second for the fourth simulated time period from five hundred to one thousand seconds, and increments of one second for a fifth simulated time period extending beyond one thousand seconds.

In alternative embodiments, the simulation increments may be kept constant throughout the entire simulation. That is, the initial one quarter second increment size may be used for a complete simulation of five thousands seconds or more. Likewise, initial increments of one eighth or one sixteenth second could be used for the entire simulation. The preferred embodiments increase the increment size as suggested above to reduce the number of calculations and therefore reduce the actual time required to perform simulations. In similar fashion, the particular simulated time periods during which various increments are used may be changed if desired.

The data calculated in step 204, i.e. pressures and volumes in the test system 10, are preferably recorded for generation of various curves that allow visual analysis of the results. For simulated time increments of less than one second it is generally preferred to record the calculated data for each increment. For simulated time increments of one second, data may be recorded at progressively longer intervals throughout the simulation.

In a preferred simulation starting with one quarter second increments, the data is preferably recorded at intervals of one quarter second for the first fifty simulated seconds, at intervals of one half second for the second fifty simulated seconds, at intervals of one second for simulated time from one hundred to five hundred seconds, at intervals of two seconds for simulated time from five hundred seconds to one thousand seconds, at intervals of five seconds for simulated time from one thousand seconds to two thousand seconds, at intervals of ten seconds for simulated time from two thousand seconds to three thousand seconds, at intervals of fifty seconds for simulated time from three thousand seconds to five thousand seconds, and at intervals of one hundred seconds for simulated time beyond five thousand seconds, if any.

In a preferred simulation starting with one eighth second increments, the data is preferably recorded at intervals of one eighth second for the first fifty simulated seconds, at intervals of one quarter second for the second fifty simulated seconds, at intervals of one half second for simulated time from one hundred to five hundred seconds, at intervals of one second for simulated time from five hundred seconds to one thousand seconds, at intervals of three seconds for simulated time from one thousand seconds to two thousand seconds, at intervals of five seconds for simulated time from two thousand seconds to three thousand seconds, at intervals of twenty-five seconds for simulated time from three thousand seconds to five thousand seconds, and at intervals of fifty seconds for simulated time beyond five thousand seconds, if any.

In a preferred simulation starting with one sixteenth second increments, the data is preferably recorded at intervals of one sixteenth second for the first fifty simulated seconds, at intervals of one eighth second for the second fifty simulated seconds, at intervals of one quarter second for simulated time from one hundred to five hundred seconds, at intervals of one-half second for simulated time from five hundred seconds to one thousand seconds, at intervals of two seconds for simulated time from one thousand seconds to two thousand seconds, at intervals of three seconds for simulated time from two thousand seconds to three thousand seconds, at intervals of thirteen seconds for simulated time from three thousand seconds to five thousand seconds, and at intervals of twenty-five seconds for simulated time beyond five thousand seconds, if any.

Returning to FIG. 2, after running the simulation in step 106, the results of the simulation are displayed at step 108. As a minimum, these results should include the times to reach the optimization parameters recorded in step 208 of FIG. 3. Other data, such as a pressure in the borehole versus time curve may also be displayed. Based on the displayed data, an operator at step 110 may determine whether the simulation indicated that the test would have been performed in a desirable time interval of from one to two hours, or other time interval that may be determined to be desirable and whether the data collected would be of good quality. If the simulated time interval is too short or too long, then at step 112, the proposed chamber model may be adjusted, i.e. changed, and input to step 102 for repeating the process. This adjustment step may be repeated until the simulation process indicates that the test will be performed in a desirable time period. When a desirable time period is indicated, then at step 114 the final test chamber model may be used to build an actual closed-chamber drillstem test system 10 and operate it in the well for which the design process has been performed.

In FIG. 2, the model adjustments in step 112 may be made in various ways. Simple stepwise adjustments of test system 10 parameters may be made until an acceptable simulation result is achieved. Alternatively two or more simulations may be run for models with relatively large variations in parameters, and an interpolation may be made based on the simulation results. For example, if simulation of a first model indicates test completion in one hour and simulation of a second model indicates test completion in two hours, a model with parameters half way between the first two is likely to provide a simulated test completion in about one and one-half hours hour, i.e. in the middle of the desirable range. Interpolation may be done mathematically, graphically or automatically. In actual testing, it has been found that a reservoir engineer can design an optimized model in relatively few iterations and a short time due to the speed of the simulations.

The above described simulation process is quite simple primarily because of the incremental method used to simulate the performance of the model test chambers. The assumption of constant pressure over each time increment reduces the number of variables making it possible to calculate flow volumes using partial differential equations in Laplace space and to use the available correlations for the pressure-volume-temperature, PVT, calculations needed to determine conditions at each simulated time increment. If desired, Darcy equations may be used to calculate flow volumes. In a preferred embodiment, partial differential equations in Laplace space are used to calculate flow volumes unless and until instability is found in the calculations, which may occur late in a simulation when pressure changes occur slowly. In the event such instabilities are detected, it is preferred to complete the remainder of the simulation using Darcy equations. A single simulation can be run in only a few seconds of time on a typical personal computer and the simulated results can be provided to a reservoir engineer essentially in real time. The engineer can therefore make adjustments and quickly arrive at an optimized design.

As noted above, the assumption of constant pressure during each increment reduces the number of variables and allows the desired flow calculations to be made. A feature of the present invention is that by assuming one variable is constant over small time increments, it becomes possible to solve the equations needed to simulate a formation flow test. In the preferred embodiment, borehole pressure is the variable that is assumed to be constant. It is apparent that the number of variables can be reduced by assuming another variable to be constant during each time increment and the necessary calculations would also be facilitated. For example, it may be possible to reduce the number of variables by assuming that flow rate is constant during each time increment to achieve the same ability to calculate the incremental changes in volumes and pressures as described herein.

As noted above, some of the well parameters that strongly affect flow of formation fluids may not be known precisely, but may instead be indicated in terms of ranges of possible values. For example, formation permeability is one of the main parameters affecting the fluid flow rate. When such parameters are only estimated in terms of ranges, it is preferred to run multiple simulations at various combinations of the parameters, covering the extremes of the unknown parameters. In such a case, the model with the longest test completion time may be chosen for building an actual drillstem test system 10.

As suggested above, a test time of from one to two hours may be considered acceptable to most reservoir engineers. A preferred design approach may be to run simulations in an effort to identify a design that will provide a one hour test period at best case conditions. If actual conditions are not best case, the test may be extended and will likely be completed within two hours. It is also preferred to use downhole data systems that transmit pressure and other parameters to the surface in real time during the actual well test. A reservoir engineer may then monitor the data, e.g. pressure adjacent the perforations 16, and can determine whether the test is actually completed, e.g. in one hour, or should be extended, e.g. to two hours or more. Such systems reduce the likelihood of a premature ending of a test that is taking longer than expected.

In FIG. 3, step 206, one or more optimization parameters are detected. An optimization parameter is a value that indicates that a test has been substantially completed so that there is little value in continuing the test. During the design process of this embodiment, the simulation is preferably continued beyond the selected optimization values so that simulated time to reach each of the optimization values may be determined and displayed. In an actual test, the test may be terminated when a selected optimization value has been reached.

A preferred optimization value is the difference between initial or natural reservoir pressure and the pressure in the well at the perforations, $\Delta Pw$. When this pressure difference reaches a small value, produced fluid flow will have essentially stopped and it can be assumed that enough data has been collected to perform desired analyses. A preferred pressure differential value is seven psi, but other values, for example from five to ten psi, may be used to indicate test completion if desired. In general, any value below twenty-five psi may be suitable to indicate substantial completion of a test.

An alternative, or additional, optimization parameter may be the productivity index, which is the ratio of flow rate over the draw-down pressure. A value of about 0.07 barrels per day per psi may be used to indicate test completion, but other values, for example from 0.05 to 0.10 barrels per day per psi, may be used to indicate test completion if desired. In general, any value below 0.25 barrels per day per psi may be suitable to indicate substantial completion of a test.

Another alternative, or additional, optimization parameter may be the pressure derivative. In conventional well testing, radial flow starts approximately one to 1.5 log cycles after the end of the initial unit-slope wellbore storage line in the log-log pressure and derivative plot versus time. The time of the maximum point on the pressure derivative plot is used as a reference point, which occurs later than the end of the unit-slope line. A test duration of about 1.3 log cycles after this reference point may be used to indicate test completion, but other values, for example from 1.0 to 1.5 log cycles, may be used to indicate test completion if desired. In general, any value below 2.0 log cycles may be suitable to indicate substantial completion of a test.

Before performing an actual closed-chamber drillstem test, it is often desirable to remove drilling fluids from the rathole area 32 and from the skin damage zone of the formation 18. This can be done in various ways. For example it is possible to open both valves 26 and 28 and allow formation fluid to flow through tubing 20 until it has flushed out the damage zone and the borehole. In other cases, a junk chamber is used to flush out the rathole area 32 and the formation. A junk chamber may be essentially another closed-chamber test system just like system 10 shown in FIG. 1. It may be positioned below the reservoir 18 or may be positioned above the reservoir 18, but below the actual closed-chamber test system 10. In either case, the methods taught herein may be used to simulate the performance of a junk chamber and allow iterative adjustment of the junk chamber parameters to assure that it performs properly.

The present invention provides a method for designing a closed-chamber drillstem test system with a high level of confidence that it will operate as desired. Once the design process has been completed, the final design may be used to actually build a closed-chamber drillstem test system and operate it in a well. If a junk chamber is desired, the system may be used to design the junk chamber. The junk chamber and test chamber 10 may be run into a well as a single work string. If the well is cased and has not been perforated, a perforating gun may also be run in as part of the same work string. After such a work string is in place, and packer 24 has been deployed, the perforating charges may be fired. The junk chamber may then be opened to flush the perforations and rathole of drilling fluids. The junk chamber valve would then normally be closed and the well would be shut in until conditions in the well stabilize. When the well pressure has stabilized at the natural formation pressure, the test chamber valve 26 may be opened to perform the closed-chamber test. When the main chamber 30 test is completed, the valve 28 may be opened to allow the formation to flow into the entire wellbore and conduct a standard pressure drawdown followed by a pressure buildup test. Pressure and other data collected during the perforation event, the junk chamber operation, and the main chamber test may then be analyzed by known methods to closely evaluate formation parameters. The produced fluids in the chamber 30 may be flowed to the surface by opening valves 26 and 28 or the tubing 20 may be removed from the well with the produced fluid sample in place.

In the above described embodiments, the formation test system is a closed chamber test system in which an initial gas cushion 34 remains in the test chamber throughout the test and is compressed and pressure increases as produced fluids flow into the chamber. In an alternate embodiment, the pressure of the initial gas cushion 34 may be maintained substantially constant during the test. Constant pressure may be achieved by adding a pressure relief valve at the location of the upper valve 28 in FIG. 1, or making the valve 28 function as a pressure relief valve. As well known in the art, a pressure relief valve will establish a maximum pressure in the gas cushion as the gas cushion is displaced by produced fluids. The gas cushion pressure may be considered constant even though in practice the initial gas cushion pressure may be somewhat below the relief valve release pressure for safety and other reasons. By use of a constant pressure in the gas cushion 34, the chamber 30 may be made smaller and/or a larger sample of produced fluids may be collected with a given size of chamber 30. The same simulator described above may be used to simulate performance of a formation tester with constant pressure in gas cushion 34. This may be done by specifying the volume of gas cushion 34 to be very large or essentially infinite at the start of the simulation. As fluids flow into the chamber 30, there will be no increase in pressure in the gas cushion 34 and the only pressure increase in the wellbore 32 adjacent the formation will result from the increase in fluid head of fluid cushion 36. The total length of fluid cushion 36 at the end of a simulated test may then be used as the minimum length of chamber 30 for purposes of building an actual tester. An additional length may then be added to chamber 30 to accommodate a small gas cushion 34 at the end of the test and to account for possible variations in produced fluid density.

In another embodiment, the simulator described herein may be used to simulate an open chamber formation test system. In such a system, the valve 28 may be open or omitted and the tubing 20 may be filled with gas at atmospheric pressure from the top of fluid cushion 36 to the surface location of the well 12. Such a system may be simulated as described in the previous paragraph by specifying the volume of gas cushion 34 as very large or infinite and starting pressure as atmospheric. The starting pressure at lower valve 26 would be specified primarily by the length and density of fluid cushion 36. In this open chamber test, simulations according to the present invention may be used in several ways.

If the available length of the tubing 20 is sufficient to accomodate a fluid head, including initial fluid cushion 36, with pressure at least equal to initial formation pressure, then the simulation will estimate the total time required to complete a formation test to the end points described above. Gas cushion pressure is assumed to not be adjustable in this open chamber case. Fluid cushion 36 initial pressure is adjustable by adjusting its length and density. The diameter of the chamber 30 may also be adjusted to optimize the total volume that would be produced and the total test time. The simulation results may indicate that an open chamber test is not recommended, because it may take too long or require excessive produced fluids as compared to a closed chamber test.

If the available length of the tubing 20 is not sufficient to accomodate a fluid head, including initial fluid cushion 36, with pressure at least equal to initial formation pressure, then the simulation may estimate the total time required to fill the tubing 20 with produced fluids and the maximum bottom-hole pressure that would result. The model may be optimized based on density of fluid cushion 36. The diameter of the chamber 30 may also be adjusted to optimize the total volume that would be produced and the total test time. The simulation results may indicate that an open chamber test is not recommended, because it may not be possible to collect a desired range of data or it may take too long or require excessive produced fluids as compared to a closed chamber test.

While the formation testers in the above described embodiments are part of a work string, e.g. a drill string, extending from a surface location of a well to the formation to be tested, it is apparent that other systems may be designed and optimized according to the present invention. For example, the test system shown in FIG. 1, may be carried into a well on a wireline or slickline and operated without a tubing or other work string in the well. The design optimization process described herein will work equally well for such a test system. While such systems have been described with respect to use for testing hydrocarbon producing formations, it is apparent that they may be used for testing the productive capacities of formations that produce water or other fluids.

While the present invention has been described with reference to particular systems and methods of operation, it is apparent that various modifications thereof may be made within the scope of the present invention as defined by the appended claims.

The invention claimed is:

1. A method for designing a closed-chamber formation test system, comprising:

a. collecting data identifying physical and fluid properties of an earth formation and a well drilled through the formation;

b. estimating initial parameters of the closed-chamber formation test system for testing the earth formation, comprising an initial pressure in a test chamber of the test system and the test chamber volume, c. simulating a closed-chamber formation test over a period of time by:

c1. calculating a first volume of fluids that would flow into the test chamber during a first time increment based on a pressure in the well adjacent the formation remaining constant during the first time increment, and the collected data, c2. calculating a new pressure in the well adjacent the formation based on the first volume of fluids calculated for the first time increment, c3. repeating c1 and c2 for a plurality of additional time increments;

d. comparing the simulated time to complete the test to a preselected testing time range;

e. adjusting initial estimated parameters of the closed-chamber formation test system and repeating c1, c2, and c3 using the data and adjusted parameters, if the simulated time to complete the test is not within the preselected testing time range;

f. outputting to a storage medium a final set of parameters for designing the closed-chamber formation test system when the simulated time to complete the test is within the preselected testing time range.

2. A method according to claim 1, further comprising:

after each time increment using the data and calculated test chamber parameters to determine if a simulated closed-chamber formation test is substantially complete.

3. The method according to claim 1, further comprising:

g. using the final set of parameters to build an actual closed-chamber drillstem test system when the simulated time to complete the test is within the preselected testing time range.

4. The method according to claim 1, wherein the time increments are each of a first length for a first simulated time period, the lime increments are each of a second length, longer than said first length, for a second simulated time period following the first time period and the time increments are each of a third length, longer than the second length, for a third time period following the second time period.

5. The method according to claim 4, wherein the first time increment length is about one quarter second and the first simulated time period is about fifty seconds, the second time increment length is about one half second and the second simulated time period is about fifty seconds, and the third time increment length is about one second.

6. The method according to claim 4, further comprising:

determining whether the volume calculated in c1 or the pressure recalculated in c2 exceeds physically possible values; and reducing the first time increment length and repeating steps c1, c2, and c3, if the volume calculated in c1 or the pressure calculated in c2 exceeds physically possible values.

7. The method according to claim 4, wherein the time increment first length is about one quarter second further comprising:

determining whether the volume calculated in step c or the pressure calculated in step d exceeds physically possible values, and if the volume calculated in step c or the pressure calculated in step d exceeds physically possible values, reducing the time increment first length to about one eighth second and repeating c1, c2, and c3.

8. The method according to claim 7, wherein the first time increment length is about one eighth second and the first simulated time period is about fifty seconds, the second time increment length is about one quarter second and the second simulated time period is about fifty seconds, and the third time increment length is about one half second.

9. The method according to claim 7, further comprising:

determining whether the volume calculated in step c or the pressure calculated in step d exceeds physically possible values, and if the volume calculated in step c or the pressure calculated in step d exceeds physically possible values, reducing the first time increment length to about one sixteenth second and repeating c1, c2, and c3.

10. The method according to claim 9, wherein the first time increment length is about one sixteenth second and the first simulated time period is about fifty seconds, the second time increment length is about one eighth second and the second simulated time period is about fifty seconds, and the third time increment length is about one quarter second.

11. A method for optimizing the design of a closed-chamber formation test system, comprising:

producing an initial model of a closed-chamber drillstem test system for testing an earth formation, the model comprising model parameters of a pressure in the test chamber and chamber volume;

simulating the operation of the test system model over a period of time, the simulating comprising:

dividing the period of time into a plurality of time increments;

calculating the flow of fluids into the test chamber during each time increment based on the test chamber pressure and volume remaining constant during each time increment and the flow rate of fluids from the formation;

comparing the time at which the simulated operation would be considered completed to a preselected range of test times;

adjusting the initial model parameters and repeating the simulating the operation of the test system model, if the simulated time is not within the preselected range; and outputting to a storage medium a final set of parameters that optimizes the design of the closed-chamber formation test system when the simulated time to complete the test is within the preselected testing time range.

12. The method according to claim 11, further comprising:

at the end of each time increment, comparing test chamber parameters to one or more optimization parameters and determining whether the simulated operation would be considered completed.

13. The method according to claim 11, further comprising: using the final set of parameters to build an actual closed-chamber drillstem test system when the simulated time to complete the test is within the preselected testing time range.

14. The method according to claim 11, further comprising:

simulating the operation of a closed-chamber test system having a gas cushion and a pressure relief valve to limit a maximum pressure in the gas cushion during a test by producing an initial model with a gas cushion having about an infinite volume and using the calculated total volume of produced fluids to determine a minimum actual test chamber length.

15. A method for optimizing the design of an open chamber formation test system, comprising:

producing an initial model of an open chamber drillstem test system for testing an earth formation, the model comprising a chamber having an upper end open to atmospheric pressure and a liquid cushion establishing initial pressure adjacent the formation;

simulating the operation of the test system model over a period of time, the simulating comprising:

dividing the period of time into a plurality of time increments;

calculating the flow of fluids into the test chamber during each time increment assuming that one of the well pressure at the beginning of each time increment and the flow rate of fluids from the formation remain constant during each time increment;

comparing test chamber parameters to one or more optimization parameters and determining whether the simulated operation would be considered completed at the end of each time increment; and outputting to a storage medium the simulated time at which the simulated operation would be considered completed.

16. A method according to claim 15, further comprising:

at the end of each time increment, comparing the volume of total produced fluids to the volume of the test chamber; and outputting the simulated time at which the volume of total produced fluids equals the volume of the test chamber, as an indication of test completion time.

* * * * *

UNITED STATES PATENT AND TRADEMARK OFFICE

CERTIFICATE OF CORRECTION

PATENT NO. : 7,197,398 B2
APPLICATION NO. : 11/084567
DATED : March 27, 2007
INVENTOR(S) : Mehdi Azari It is certified that error appears in the above-identified patent and that said Letters Patent is hereby corrected as shown below:

Col. 14, line 32, replace “lime” with --time--.

Signed and Sealed this

Sixth Day of November, 2007

JON W. DUDAS
*Director of the United States Patent and Trademark Office*